US011137194B2

(12) United States Patent
Richardson

(10) Patent No.: US 11,137,194 B2
(45) Date of Patent: Oct. 5, 2021

(54) CONTACT DEFROST HEATER FOR BOTTOM MOUNT TO EVAPORATOR

(71) Applicant: Electrolux Home Products, Inc., Charlotte, NC (US)

(72) Inventor: Edmund Scott Richardson, Simpsonville, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 112 days.

(21) Appl. No.: 16/518,122

(22) Filed: Jul. 22, 2019

(65) Prior Publication Data

US 2021/0025640 A1 Jan. 28, 2021

(51) Int. Cl.
*F25D 21/08* (2006.01)
*F25D 21/14* (2006.01)

(52) U.S. Cl.
CPC ..... *F25D 21/08* (2013.01); *F25D 21/14* (2013.01)

(58) Field of Classification Search
CPC ... F25D 21/08; F25D 2321/1413; F25D 21/14
See application file for complete search history.

(56) References Cited

U.S. PATENT DOCUMENTS 4,369,350 A 1/1983 Kobayashi et al.
6,626,004 B2 9/2003 Lee
2009/0165486 A1 7/2009 Harlen
2011/0138834 A1 6/2011 Maeda
2020/0173708 A1* 6/2020 Kim ..... F25D 11/02

FOREIGN PATENT DOCUMENTS

CN 102095300 A * 6/2011 ..... F25D 21/08
CN 108344206 A * 7/2018
EP 3267132 A1 * 1/2018 ..... F25D 21/08
KR 20030041685 A * 5/2003
KR 20120039488 A * 4/2012 ..... F28D 1/0477

OTHER PUBLICATIONS

Li Machine Translation (Year: 2018).*
Yoon Machine Translation (Year: 2003).*
Translation of EP 3267132 (Year: 2018).*

* cited by examiner

*Primary Examiner* — Cassey D Bauer
*Assistant Examiner* — Rodrigo Royo
(74) *Attorney, Agent, or Firm* — Pearne & Gordon LLP

(57) ABSTRACT

Provided is a refrigeration appliance including a storage compartment and an evaporator that cools the storage compartment. The evaporator includes a plurality of evaporator fins. A defrost heater is mounted at a bottom edge of the evaporator fins. The defrost heater includes a first section and a second section. The first section is in physical contact with the evaporator fins. The second section is spaced a distance away from the evaporator fins. The first section has a relatively higher power output than the second section A method of defrosting an evaporator of a refrigeration appliance is also provided.

17 Claims, 13 Drawing Sheets

CONTACT DEFROST HEATER FOR BOTTOM MOUNT TO EVAPORATOR

CROSS-REFERENCE TO RELATED APPLICATIONS

Not applicable.

FIELD OF INVENTION

This application relates generally to a refrigeration appliance, and more particularly, to a contact radiant defrost heater on a refrigerator evaporator.

BACKGROUND OF INVENTION

Refrigeration appliances, such as domestic refrigerators, are provided with a cooling/refrigeration system for the purpose of generating and dispersing cold air into the refrigeration cavities. A typical refrigerator includes a freezer compartment that operates at a temperature below freezing and a fresh-food compartment that operates at a temperature between the ambient temperature (that is, the temperature in the space outside the refrigerator cabinet) and freezing. The refrigeration system can include either a standard compressor or a variable speed compressor, a condenser, a condenser fan, an evaporator connected in series and charged with a refrigerant, and an evaporator fan. The evaporator fan circulates cooling air through the refrigerator compartments and improves heat transfer efficiency. Because the evaporator has a surface temperature lower than 0° C. when the refrigeration system operates, moisture absorbed into the cooling air during circulation of the cooling air forms frost on the relatively cooler surface of the evaporator. Accumulation of frost may become ice, which can disturb the flow of the cooling air passing by the evaporator and can reduce the heat exchange efficiency of the evaporator. Conventional refrigerators use a defrost heater to eliminate frost buildup on the evaporator coils. After defrost, the compressor is typically run for a predetermined time to lower the evaporator temperature.

Conventionally, a contact radiant defrost heater is mounted at the front and/or rear side of the evaporator. A contact radiant defrost heater is typically mounted at the bottom of the evaporator. The International Electrotechnical Commission (IEC) mandates limits on the surface temperature of the defrost heaters in refrigerators that use R600a flammable refrigerant. According to the Underwriters Laboratories Inc. (UL) 250 standards, when a refrigerant has been leaked, the surface temperature of a defrost heater is restricted to be lower by 100° C. than the ignition point of the refrigerant, in order to prevent firing of the refrigerant. Therefore, when using refrigerants such as R600a, safety regulations typically require that the surface temperature of the defrost heater is below 394° C. because of the 494° C. ignition point of the R600a refrigerant. Therefore, it is desirable to provide a defrost heater configuration that complies with the IEC and UL 250 temperature requirements.

BRIEF SUMMARY OF THE INVENTION

In accordance with one aspect, there is provided a refrigeration appliance including a storage compartment, an evaporator that cools the storage compartment, and a defrost heater. The evaporator has a plurality of evaporator fins and the defrost heater is configured to be mounted at a bottom edge of the evaporator fins. The defrost heater includes at least a first section and a second section. The first section of the defrost heater is in physical contact with the evaporator fins. The second section of the defrost heater is spaced a distance away from the evaporator fins. The first section of the defrost heater is configured with a relatively higher power output than the second section of the defrost heater.

In the refrigeration appliance according to the foregoing aspect, the evaporator fins include a plurality of slots formed at the bottom edge of the evaporator fins. The slots are configured to receive a corresponding portion of the defrost heater including the first section of the defrost heater.

In the refrigeration appliance according to the foregoing aspect, each of the slots is configured to provide a fitted pocket for the corresponding portion of the defrost heater. The fitted pocket creates an effective surface contact to increase a heat transfer and reduce the surface temperature of the defrost heater.

In the refrigeration appliance according to the foregoing aspect, the defrost heater includes an elongated heater tube and an electrical resistance wire wound in a spiral manner around a cylindrical core. The electrical resistance wire and the cylindrical core are arranged within the heater tube.

In the refrigeration appliance according to the foregoing aspect, the heater tube includes a departing section configured to depart from the evaporator fins when the defrost heater is mounted at the bottom edge of the evaporator fins.

In the refrigeration appliance according to the foregoing aspect, the departing section is at least one of a U-shaped and/or a V-shaped section.

In the refrigeration appliance according to the foregoing aspect, the departing section is arranged proximate to an auxiliary defrost area. The departing section is configured to melt frost and ice accumulated around the auxiliary defrost area during a defrost cycle.

In the refrigeration appliance according to the foregoing aspect, the auxiliary defrost area is proximate to at least one of an evaporator drain, a back side of a protective panel of the evaporator, an opening formed in a bottom of a drain trough or any portion of the drain trough, and/or beyond the left and right ends of the defrost heater extending beyond the evaporator.

In the refrigeration appliance according to the foregoing aspect, the heater tube includes at least one straight section configured to be received within corresponding slots formed at the bottom edge of the evaporator fins.

In the refrigeration appliance according to the foregoing aspect, the heater tube includes at least two straight sections arranged on either side of the departing section. Each of said at least two straight sections is configured to be received within corresponding slots formed at the bottom edge of the evaporator fins.

In the refrigeration appliance according to the foregoing aspect, the at least one straight section is configured with a relatively higher power output than the power output of the departing section.

In the refrigeration appliance according to the foregoing aspect, the density of the electrical resistance wire of the at least one straight section is higher than the density of the electrical resistance wire of the departing section.

In the refrigeration appliance according to the foregoing aspect, a power supply is configured to supply power to the defrost heater.

In accordance with another aspect, there is provided a method of defrosting an evaporator of a refrigeration appliance with a defrost heater associated with the evaporator and the evaporator having a plurality of evaporator fins. The method includes forming a plurality of slots at a bottom edge of the evaporator fins. The method further includes configuring the defrost heater with a departing section that departs from the evaporator fins when the defrost heater is mounted at the bottom edge of the evaporator fins and at least one straight section. The method also includes mounting the defrost heater at the bottom edge of the evaporator fins, such that each of the plurality of slots forms a fitted pocket configured to receive a corresponding portion of the at least one straight section. The method further includes arranging the departing section proximate to an auxiliary defrost area. The method also includes energizing the departing section and the at least one straight section at different power levels to defrost the evaporator. The method further includes melting frost and ice accumulated around said auxiliary defrost area by the departing section during defrost.

In the method of defrosting an evaporator of a refrigeration appliance according to the foregoing aspect, the method further includes reducing the surface temperature of the defrost heater by transferring heat from the defrost heater to the evaporator fins.

In the method of defrosting an evaporator of a refrigeration appliance according to the foregoing aspect, the defrost heater includes an elongated heater tube and an electrical resistance wire wound in a spiral manner around a cylindrical core. The electrical resistance wire and the cylindrical core are arranged within the heater tube.

In the method of defrosting an evaporator of a refrigeration appliance according to the foregoing aspect, the energizing of the departing section and the at least one straight section at different power levels includes energizing the at least one straight section with a relatively higher power level than the power level of the departing section.

In the method of defrosting an evaporator of a refrigeration appliance according to the foregoing aspect, the density of the electrical resistance wire of the at least one straight section is higher than the density of the electrical resistance wire of the departing section.

In the method of defrosting an evaporator of a refrigeration appliance according to the foregoing aspect, the auxiliary defrost area includes at least one of an evaporator drain, a back side of a protective panel of the evaporator, an opening formed in a bottom of a drain trough or any portion of the drain trough, and/or beyond left and right ends of the defrost heater extending beyond the evaporator.

Other features and aspects may be apparent from the following detailed description, the drawings, and the claims.

BRIEF DESCRIPTION OF THE DRAWINGS

The foregoing and other aspects of the present disclosure will become apparent to those skilled in the art to which the present disclosure relates upon reading the following description with reference to the accompanying drawings, in which.

Figure 1:
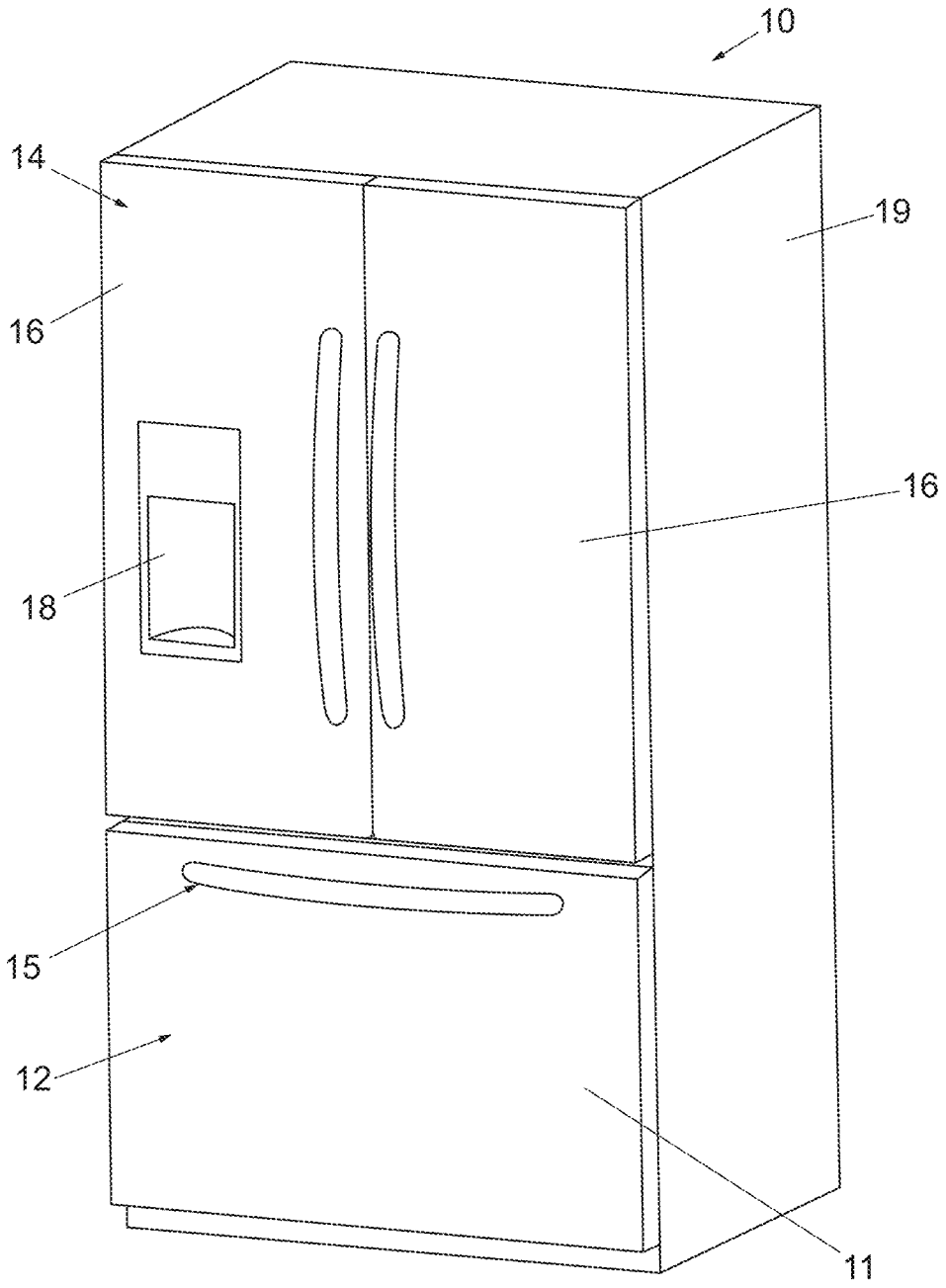
FIG. 1 is a front perspective view of a household French Door Bottom Mount refrigerator wherein doors of the refrigerator are in a closed position.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

Example embodiments that incorporate one or more aspects of the apparatus and methodology are described and illustrated in the drawings. These illustrated examples are not intended to be a limitation on the present disclosure. For example, one or more aspects of the disclosed embodiments can be utilized in other embodiments and even other types of devices. Moreover, certain terminology is used herein for convenience only and is not to be taken as a limitation.

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases, the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

Such conventional refrigerators are often provided with a unit for making ice pieces, commonly referred to as "ice cubes" despite the non-cubical shape of many such ice pieces. For refrigerators such as the so-called "bottom mount" refrigerator, which includes a freezer compartment disposed vertically beneath a fresh food compartment, the ice making unit is arranged in the fresh food compartment. Alternatively, the ice making unit may be located in the freezer compartments of the refrigerators and manufacture ice by convection, i.e., by circulating cold air over water in an ice tray to freeze the water into ice cubes. Storage bins for storing the frozen ice pieces may be provided adjacent to the ice making units. The ice pieces can be dispensed from the storage bins through a dispensing port in the door that closes the fresh food compartment or the freezer to the ambient air. The dispensing of the ice usually occurs by means of an ice delivery mechanism that extends between the storage bin and the dispensing port in the respective compartment door.

Referring now to the drawings, FIG. 1 shows a refrigeration appliance in the form of a domestic refrigerator, indicated generally at 10. Although the detailed description that follows concerns a domestic refrigerator 10, the invention can be embodied by refrigeration appliances other than with a domestic refrigerator 10. Further, an embodiment is described in detail below, and shown in the figures as a bottom-mount configuration of a refrigerator 10, including a fresh food compartment 14 disposed vertically above a freezer compartment 12. However, the refrigerator 10 can have any desired configuration including at least a fresh food compartment 14 and/or a freezer compartment 12, such as a top mount refrigerator (freezer disposed above the fresh food compartment), a side-by-side refrigerator (fresh food compartment is laterally next to the freezer compartment), a standalone refrigerator or freezer, etc.

One or more doors 16 shown in FIG. 1 are pivotally coupled to a cabinet 19 of the refrigerator 10 to restrict and grant access to the fresh food compartment 14. The door 16 can include a single door that spans the entire lateral distance across the entrance to the fresh food compartment 14, or can include a pair of French-type doors 16 as shown in FIG. 1 that collectively span the entire lateral distance of the entrance to the fresh food compartment 14 to enclose the fresh food compartment 14. For the latter configuration, a center flip mullion 21 (FIG. 2) is pivotally coupled to at least one of the doors 16 to establish a surface against which a seal provided to the other one of the doors 16 can seal the entrance to the fresh food compartment 14 at a location between opposing side surfaces 17 (FIG. 2) of the doors 16. The mullion 21 can be pivotally coupled to the door 16 to pivot between a first orientation that is substantially parallel to a planar surface of the door 16 when the door 16 is closed, and a different orientation when the door 16 is opened. The externally-exposed surface of the center mullion 21 is substantially parallel to the door 16 when the center mullion 21 is in the first orientation, and forms an angle other than parallel relative to the door 16 when the center mullion 21 is in the second orientation. The seal and the externally-exposed surface of the mullion 21 cooperate approximately midway between the lateral sides of the fresh food compartment 14.

Turning back to FIG. 1, a dispenser 18 for dispensing at least ice pieces, and optionally water, can be provided on an exterior of one of the doors 16 that restricts access to the fresh food compartment 14. The dispenser 18 includes an actuator (e.g., lever, switch, proximity sensor, etc.) to cause frozen ice pieces to be dispensed from an ice bin 54 (FIG. 2) of an ice maker 50 disposed within the fresh food compartment 14. Ice pieces from the ice bin 54 can exit the ice bin 54 through an aperture 62 and be delivered to the dispenser 18 via an ice chute 22 (FIG. 2), which extends at least partially through the door 16 between the dispenser 18 and the ice bin 54.

Referring to FIG. 1, the freezer compartment 12 is arranged vertically beneath the fresh food compartment 14. A drawer assembly (not shown) including one or more freezer baskets (not shown) can be withdrawn from the freezer compartment 12 to grant a user access to food items stored in the freezer compartment 12. The drawer assembly can be coupled to a freezer door 11 that includes a handle 15, When a user grasps the handle 15 and pulls the freezer door 11 open, at least one or more of the freezer baskets is caused to be at least partially withdrawn from the freezer compartment 12.

In alternative embodiments, the ice maker is located within the freezer compartment. In this configuration, although still disposed within the freezer compartment, at least the ice maker (and possible an ice bin) is mounted to an interior surface of the freezer door. It is contemplated that the ice mold and ice bin can be separate elements, in which one remains within the freezer compartment and the other is on the freezer door.

The freezer compartment 12 is used to freeze and/or maintain articles of food stored in the freezer compartment 12 in a frozen condition. For this purpose, the freezer compartment 12 is in thermal communication with a freezer evaporator (not shown) that removes thermal energy from the freezer compartment 12 to maintain the temperature therein at a temperature of 0° C. or less during operation of the refrigerator 10, preferably between 0° C. and −50° C., more preferably between 0° C. and −30° C. and even more preferably between 0° C. and −20° C. The freezer evaporator can be dedicated to separately maintaining the temperature within the freezer compartment 12 independent of the fresh food compartment 14.

Figure 2:
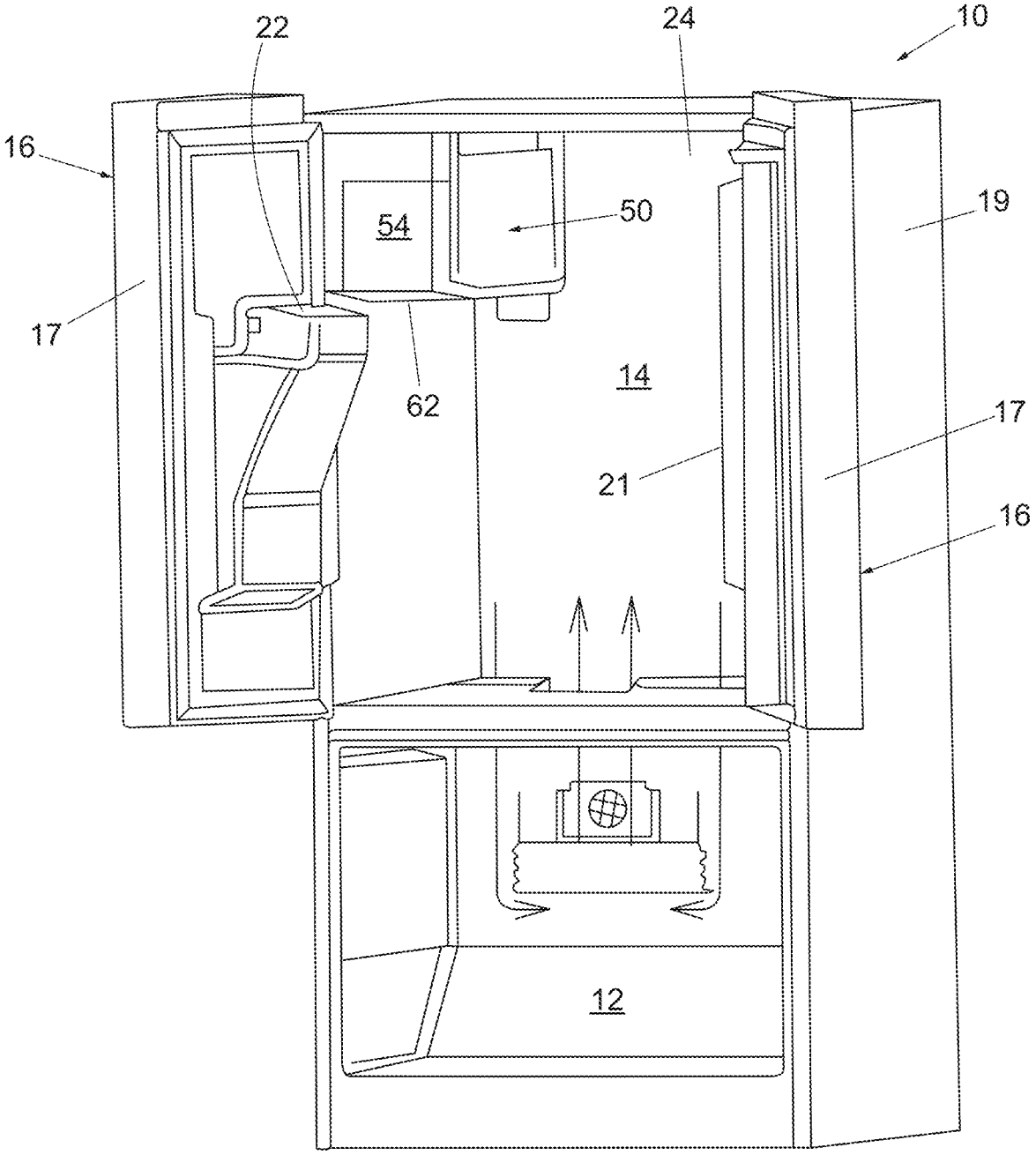
FIG. 2 is a front perspective view of the refrigerator of FIG. 1 showing the doors in an opened position and an interior of a fresh food compartment.

Referring to FIG. 2, the refrigerator 10 includes an interior liner 24 that defines the fresh food compartment 14. The fresh food compartment 14 is located in the upper portion of the refrigerator 10 in this example and serves to minimize spoiling of articles of food stored therein. The fresh food compartment 14 accomplishes this by maintaining the temperature in the fresh food compartment 14 at a cool temperature that is typically above 0° C., so as not to freeze the articles of food in the fresh food compartment 14. It is contemplated that the cool temperature preferably is between 0° C. and 10° C., more preferably between 0° C. and 5° C. and even more preferably between 0.25° C. and 4.5° C. According to some embodiments, cool air from which thermal energy has been removed by the freezer evaporator can also be blown into the fresh food compartment 14 to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator can optionally be dedicated to separately maintaining the temperature within the fresh food compartment 14 independent of the freezer compartment 12. According to an embodiment, the temperature in the fresh food compartment 14 can be maintained at a cool temperature within a close tolerance of a range between 0° C. and 4.5° C., including any subranges and any individual temperatures falling with that range. For example, other embodiments can optionally maintain the cool temperature within the fresh food compartment 14 within a reasonably close tolerance of a temperature between 0.25° C. and 4° C.

The ice maker 50 may include a designated evaporator dedicated to separately maintaining the temperature within the ice maker 50 independent of the fresh food compartment 14 and the freezer compartment 12. Alternatively, the ice maker evaporator can be a remote part of the freezer evaporator.

The cooling/refrigeration system of a refrigerator cools the storage compartments (e.g., the freezer, fresh-food compartment, and/or the ice maker) of the refrigerator. The refrigeration system can include either a standard compressor or a variable speed compressor, a condenser, a condenser fan, and an evaporator connected in series and charged with a refrigerant from the compressor, and an evaporator fan. The evaporator fan circulates cooling air through the refrigerator compartments and improves heat transfer efficiency. The condenser expels heat withdrawn by the evaporator from the fresh food compartment 14 and the freezer compartment 12, respectively.

Figure 3:
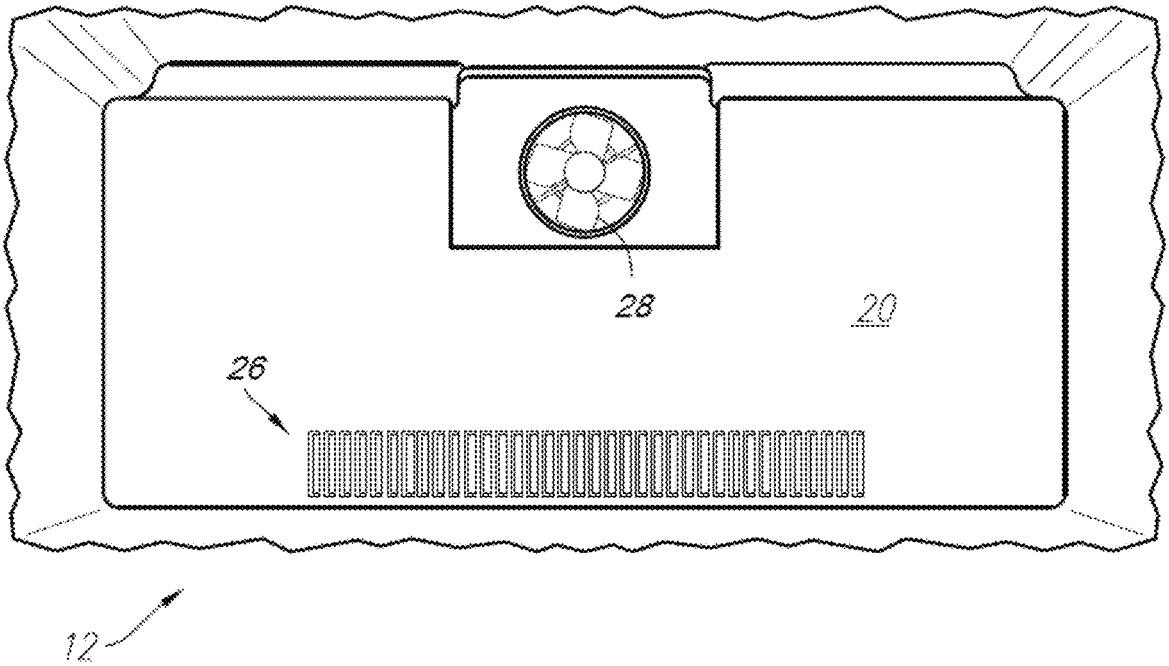
FIG. 3 is a perspective view of an example evaporator assembly, with cover panel in place.

FIG. 3 is a perspective view of an example evaporator assembly that can be located within the refrigerator 10, such as within the freezer compartment 12, for cooling the freezer compartment 12 and/or the fresh-food compartment 14. It is to be appreciated that the evaporator assembly could be located in the fresh-food compartment 14, and further that the freezer and fresh-food compartments could have separate, dedicated evaporator assemblies. Similarly, a dedicated evaporator could be used with the ice maker 50, such as in the case of an icemaker located within the fresh food compartment. Although for brevity the defrost heater of the instant application will be discussed with reference to a freezer evaporator, the claims are note intended to be so limited. It is contemplated that the defrost heater assembly could be similarly utilized with a fresh food evaporator and/or icemaker evaporator.

In many constructions, the evaporator is located behind a protective panel 20 and, therefore, is not shown in FIG. 3. Via a vent 26, a fan 28 moves air from the freezer compartment 12 across the evaporator to cool the air, and discharges the cooled air back into the freezer compartment 12.

Figure 4:
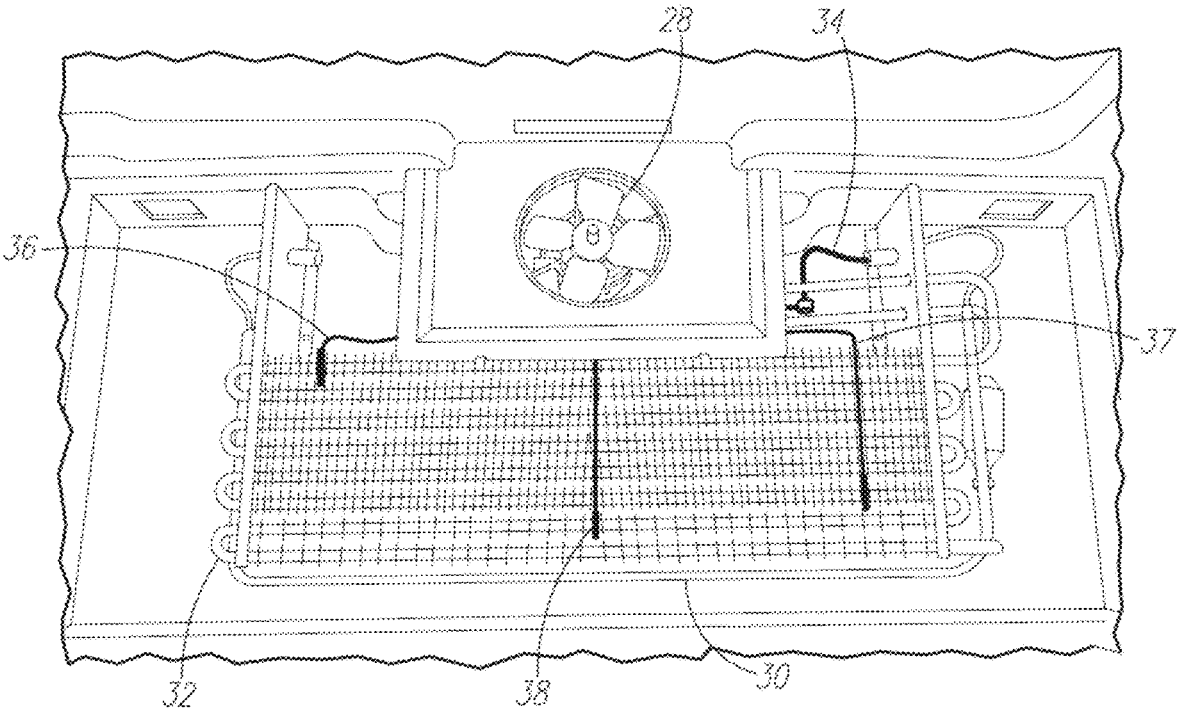
FIG. 4 is a perspective view of an example evaporator assembly, with the panel removed.

FIG. 4 is a perspective view of the evaporator assembly of FIG. 3 with the panel 20 removed. A defrost heater 30 is mounted near an evaporator 32 for removing ice from the evaporator 32, for example on the evaporator tubing and/or evaporator fins. This can be considered a primary defrost area. The defrost heater 30 shown in FIG. 4 surrounds the evaporator 32 on three sides. However, the defrost heater 30 could be mounted in other positions relative to the evaporator 32, such as behind the evaporator 32, at the front side of the evaporator 32, at the bottom of the evaporator 32, directly on the evaporator 32, etc.

In an embodiment, the defrost heater 30 can include an electric resistance heating element, such as a tubular heating element (e.g., a CALROD element). A cable 34 supplies electrical power from the refrigerator 10 to the defrost heater 30. The defrost heater 30 has a rated power (e.g., 450 watts) when operated at its rated voltage (e.g., 115 VAC).

The defrost heater 30 can be operated periodically, such as every 8 hours, every 10 hours, etc. to defrost the evaporator 32. The defrost heater 30 can be operated periodically with a fixed period between defrosting cycles that does not change. Alternatively, the defrost heater 30 can be operated according to an "adaptive defrost" scheme in which the period between defrosting cycles is dynamically changed by a controller based on the time required to complete the last defrosting operation. The defrost heater 30 can further be operated based on sensing a build-up of ice on the evaporator 32.

Temperature sensors 36, 37, 38 (e.g., thermocouple, RTD, etc.) can be located on or near the evaporator 32 for sensing the temperature of the evaporator 32. The temperature sensors 36, 37, 38 can generate respective temperature signals based on the evaporator temperature. Although three temperature sensors 36, 37, 38 are shown in FIG. 4, it is to be appreciated that any number of temperature sensors can be used as desired, such as one temperature sensor, two temperature sensors, four temperature sensors, etc. The evaporator 32 can have various "cold spots" that are the last spots on the evaporator to be defrosted, and it might be desirable to locate temperature sensors at such cold spots to help determine when the evaporator 32 is completely defrosted.

Figure 5:
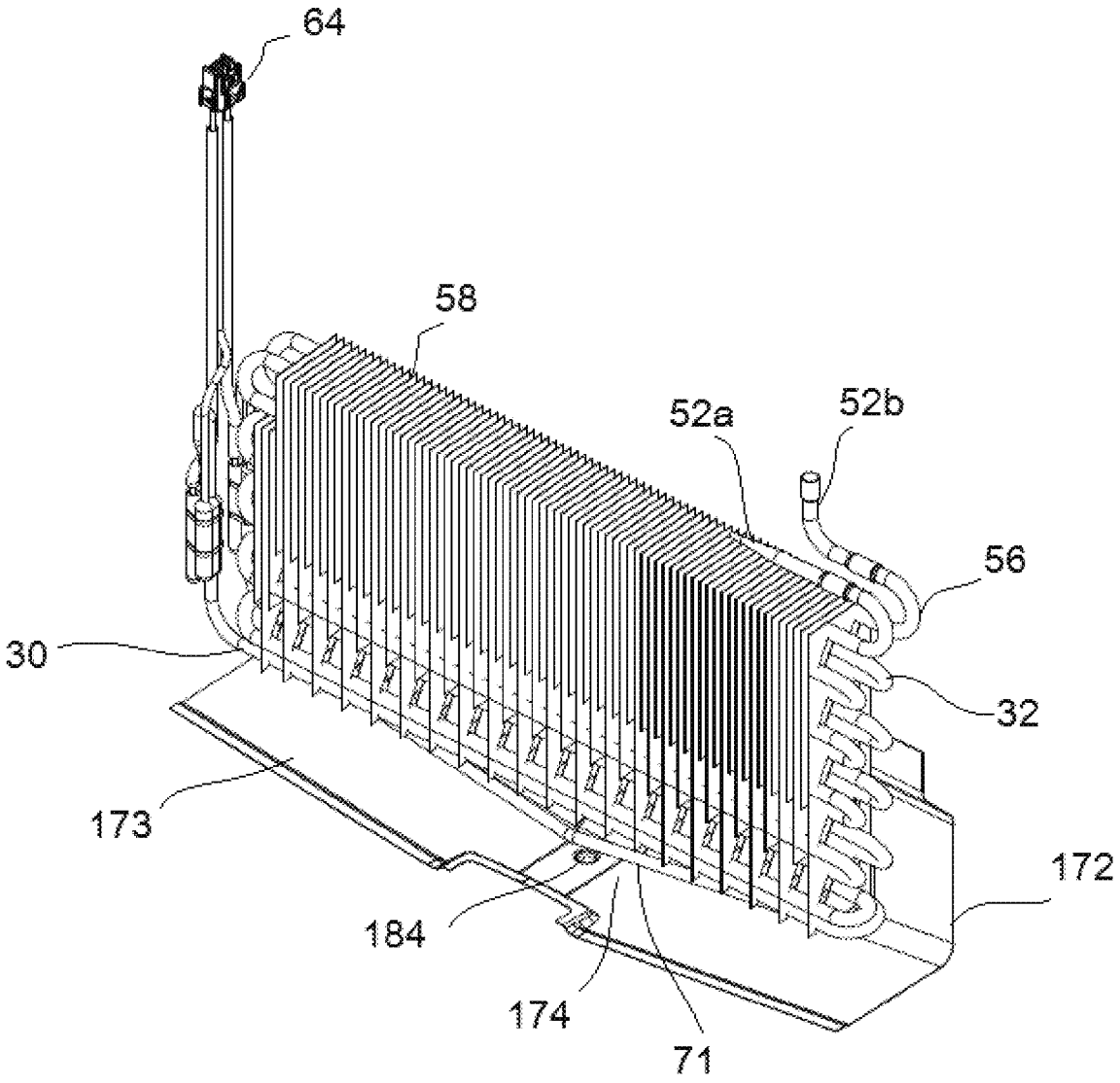
FIG. 5 is a front perspective view of an example evaporator/defrost heater assembly.

Referring now to FIG. 5, one embodiment of the instant application is illustrated whereby the evaporator 32 includes an inlet line 52*a* that is configured to be connected to a condenser of a refrigerator cooling system (not shown in FIG. 5) and an outlet line 52*b* that is configured to be connected to a compressor (not shown in FIG. 5) of the refrigerator cooling system. In general, the evaporator 32 includes a serpentine-shaped conduit 56 that passes through a plurality of evaporator fins 58. The evaporator fins 58 are planar and are made of heat conductive material, such as aluminum, for example. The evaporator fins 58 are designed to aid in the transmission of heat from the air stream to the fluid passing through the conduit 56 of the evaporator 32.

The defrost heater 30 (shown in more detail in FIG. 7A) can be a serpentine-shaped element 71 that is arranged on the bottom side of the evaporator 32. The defrost heater 30 is designed to apply heat to the evaporator 32 during a defrost cycle to metal ice/frost that may have accumulated on the evaporator 32. A suitable electrical plug 64 can be configured to connect to a corresponding connector on a wiring harness (both not shown in FIG. 5) for allowing electrical power to be supplied to the defrost heater 30, as needed.

A safety device, including but not limited to a bimetal switch, a fuse, and/or a thermostat, for example (not shown in FIG. 5, but shown as reference number 66 in FIG. 7A) can be configured to be attached to the outlet line 52*b* or to the inlet line 52*a* of the evaporator 32. The safety device can be connected in series with the defrost heater 30 for interrupting power to the defrost heater 30 when the safety device reaches a predetermined temperature during the defrost cycle. The safety device, in general, can be a switch that is designed to physically open a contact when the switch reaches the predetermined temperature. The safety device can act as a safety switch to prevent the defrost heater 30 from heating the evaporator 32 to a temperature in excess of the predetermined temperature. A single safety device can be used or at least one safety device can be added on each of the inlet line 52*a* and the outlet line 52*b*.

When the controller of the refrigerator 10 initiates a defrost cycle to melt frost and/or ice that may have accumulated on the evaporator 32, the controller can energize the defrost heater 30 such that heat is generated within the housing 172 of the evaporator/defrost assembly (only the bottom portion of the housing is shown in FIG. 5). The heat generated by the defrost heater 30 can also help to melt frost and/or ice that may have accumulated on the evaporator fan 28 (shown in FIG. 4). The melting frost and/or ice on the evaporator 32 can form drips or streams of water that fall to the lower portion (e.g., bottom) 173 of the housing 172. The water is directed to an opening 184 formed in the bottom 173 of the housing 172 and collects in a sump or fluid collection portion 174 of the housing 172, from where it may be conveyed out through a drain channel or tube (not shown in FIG. 5).

Figure 6A:
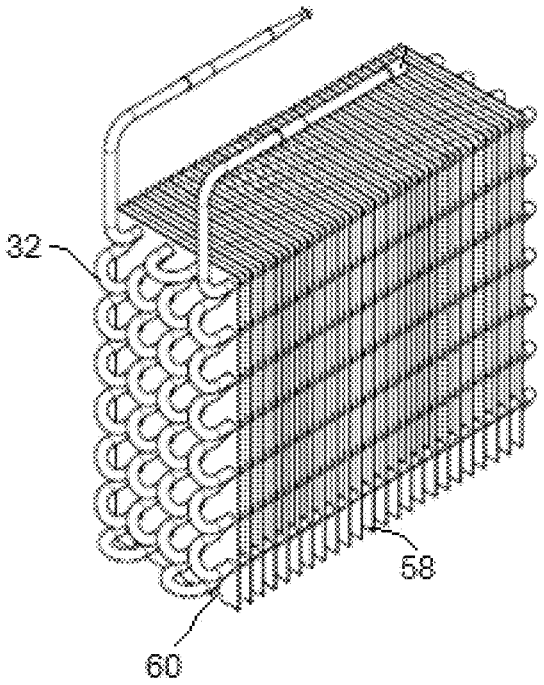
FIG. 6A is a schematic view of another example evaporator.
Figure 6B:
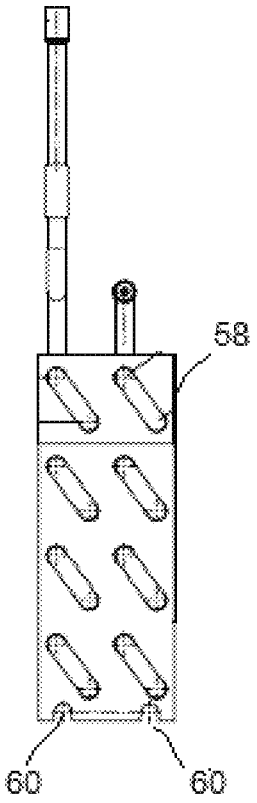
FIG. 6B is a schematic end view of another example evaporator.

Referring to FIGS. 6A and 6B, a plurality of slots or notches 60 can be formed in the bottom edge of the evaporator fins 58. The size and shape of the slots or notches 60 can be configured to complimentary receive portions of the serpentine-shaped element 71 of the defrost heater 30. Although two slots or notches 60 are illustrated in the bottom edge of the evaporator fin 58 in FIG. 6B, any number of slots or notches 60 can be provided in the bottom edge of the evaporator fins 58. The slots or notches 60 can provide a fitted pocket for the serpentine-shaped element 71 of the defrost heater 30 within the evaporator fins 58, thereby creating an effective surface contact to increase the heat transfer and reduce the surface temperature of the defrost heater 30. In one example, applying the heater in contact with the evaporator reduces the surface temperature of the heater, because the evaporator effectively becomes a heat sink and radiator.

Figure 7A:
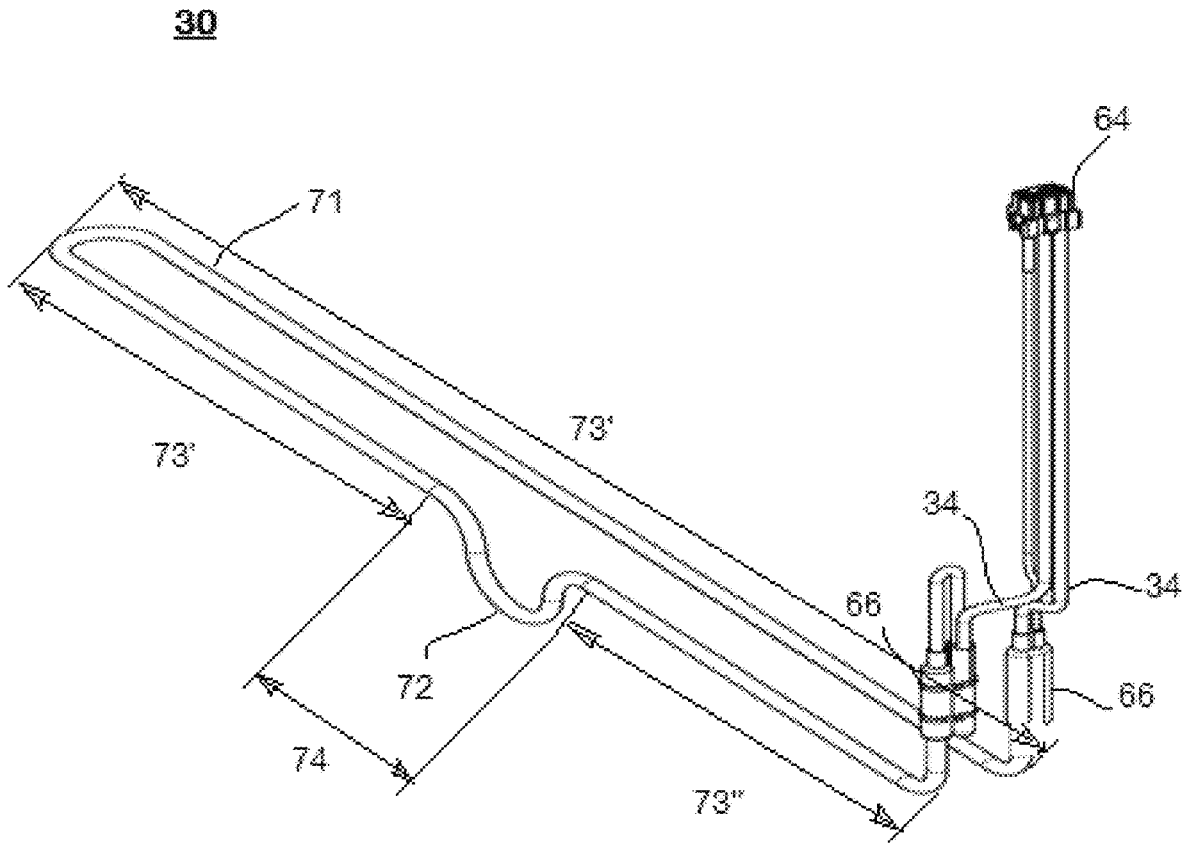
FIG. 7A is a schematic view of a defrost heater, according to an embodiment.
Figure 7B:
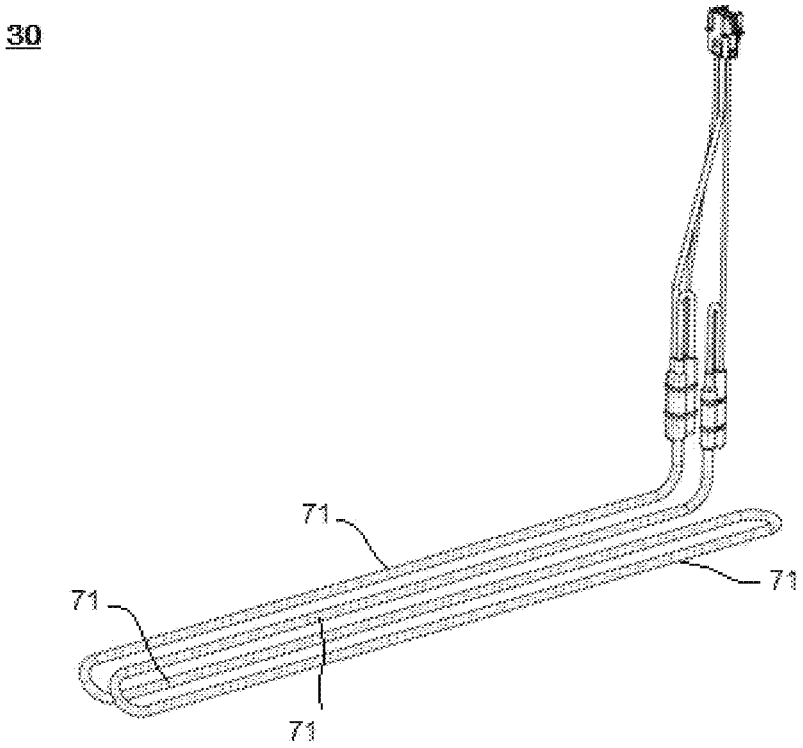
FIG. 7B is a schematic view of a defrost heater, according to another embodiment.

As illustrated in the embodiment shown in FIG. 7A, the serpentine-shaped element 71 of the defrost heater 30 can have an elongated, two-pass tubular structure, including two straight sections 71. However, embodiments are not limited thereto and other configurations are also contemplated. For example, the serpentine-shaped element 71 of the defrost heater 30 can have an elongated, four-pass tubular structure including four straight sections 71, as shown in FIG. 7B. Any other number of straight sections 71 may be contemplated in further embodiments. It is contemplated that a suitable number of slots or notches 60 are provided in the bottom edge of the evaporator fins 58 to accommodate the number of straight sections of the defrost heater 30; it may be, but is not necessarily required to be, a 1:1 relationship. Each portion of the serpentine-shaped element 71 can be formed as a heater tube 71 made of a heat conductive material, such as aluminum, for example. The heater tube 71 can define the external appearance of the defrost heater 30. A resistive element, such as an electrical resistance wire, for example (not shown in FIG. 7A, but shown later in FIG. 8), can be wound in a spiral manner around a cylindrical core arranged within the heater tube 71. An insulating cover (not shown in FIG. 7A) can be provided to insulate the electrical resistance wire 75 and the heater tube 71 from each other. The defrost heater 30 can be provided with a cable 34 comprising a pair of electrical leads configured to be connected with an electrical control system, via a harness or plug 64 (also shown in FIG. 5), for selectively energizing the defrost heater 30.

Figure 7C:
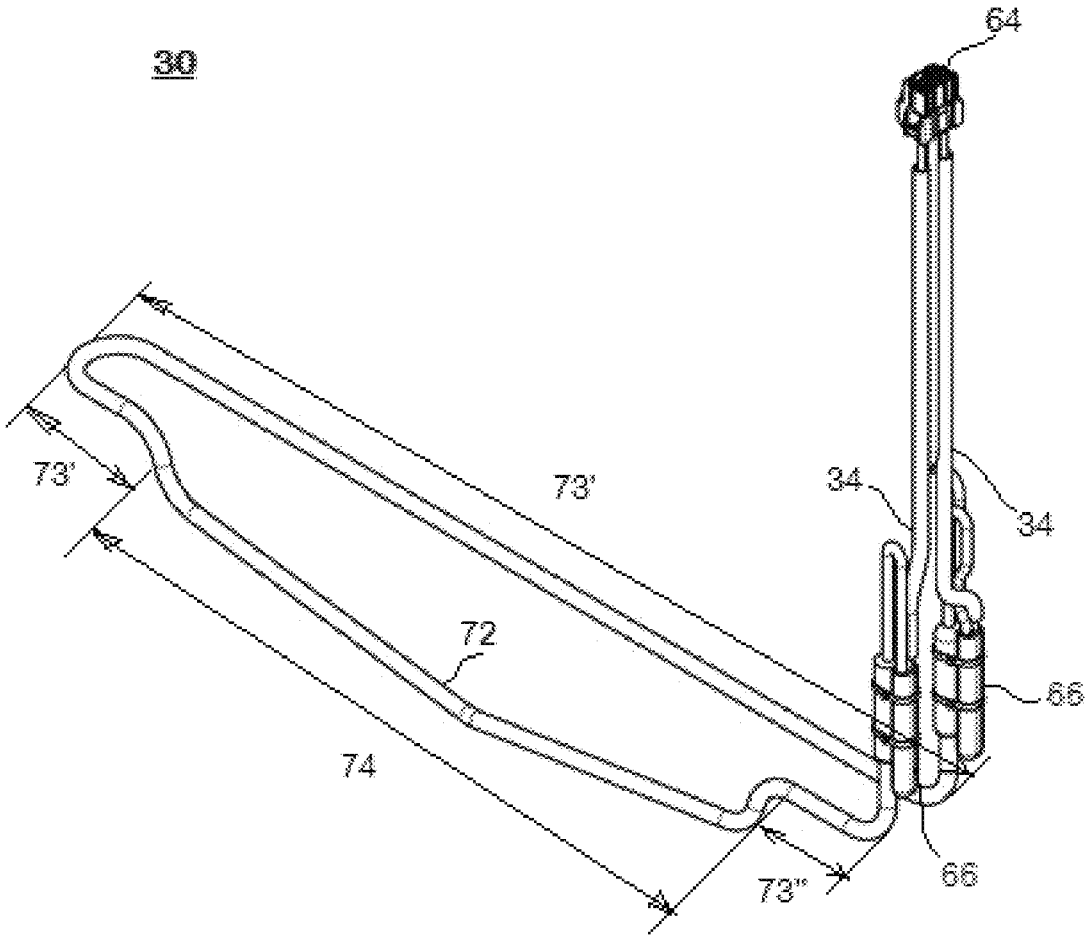
FIG. 7C is a schematic view of a defrost heater, according to another embodiment.

As shown in FIGS. 7A-7D, a departing portion 72 of the heater tube 71 of the defrost heater 30 can be shaped to depart from the evaporator fins 58 in order to be relatively closer to an auxiliary defrost area that is different from the primary defrost area. In one example, the auxiliary defrost area can be the evaporator drain or the opening 184 formed in the bottom 173 of the drain trough 174 (shown in FIG. 5), from where water that may have accumulated from melting frost and/or ice on the evaporator 32 can be conveyed out through a drain channel. For example, the departing portion 72 of the heater tube 71 of the defrost heater 30 can be at least one of U-shaped and/or V-shaped portion. However, other shapes and configurations are also possible, including a combination of both a U-shaped and/or V-shaped geometry. For example, as shown in FIG. 7C, the departing portion 72 of the heater tube 71 of the defrost heater 30 can be shaped as a wide V, as opposed to the relatively narrow U-shape illustrated in FIG. 7A. Because of this configuration, the departing portion 72 of the heater tube 71 of the defrost heater 30 can provide an appropriate heat to the evaporator drain during defrost for complete clearance of any accumulated or deposited frost or ice in the area. The departing portion 72 of the heater tube 71 of the defrost heater 30 can be arranged in any other area (e.g., another auxiliary defrost area) that might require the defrost heater 30 be closer, including but not limited to at least one of the back side of the protective panel 20 (shown in FIG. 3), any portion of the drain trough 174, and/or beyond the left and right ends of the defrost heater 30 extending beyond the evaporator 32 (as shown by any or all of the areas indicated by reference numbers 27 and 29 in FIG. 4), for example.

Figure 7D:
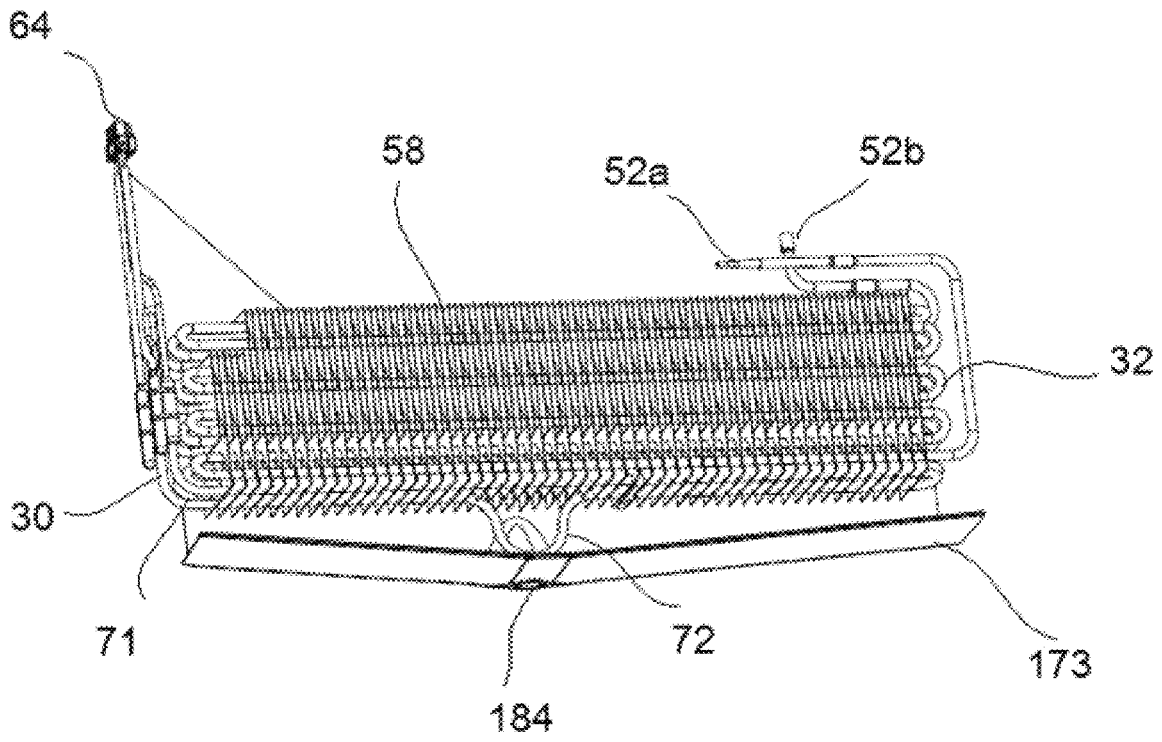
FIG. 7D is a schematic view of an evaporator/defrost heater assembly with the defrost heater of FIG. 7A, according to an embodiment.

As illustrated in FIG. 7A, sections 73' and 73" of the defrost heater 30 are in contact with the evaporator fins 58 when the defrost heater 30 is mounted to the evaporator fins 58. These sections 73' and 73" can be designed with a relatively higher power output than a middle section 74 of the defrost heater 30. The middle section 74 can, for example, include the departing portion 72 of the heater tube 71, which (as shown in FIG. 7D and as described above) would be spaced away from the evaporator fins 58, when the defrost heater 30 is installed on the bottom side of the evaporator 32. In the table below, the sections 73' and 73" of the defrost heater 30 are designated as Heat Zone 1 and Heat Zone 3, respectively. The section 74 is designated as Heat Zone 2. As indicated in the table below, Heat Zones 1 and 3 have a higher power output than Heat Zone 2. It is further contemplated that the defrost heater 30 can have more than three Heat Zones, which may include multiple separate departing portions arranged at one or more auxiliary defrost areas.

| HEAT ZONE | W/m | HEATED LENGTH [mm] | (POWER) [W] |
|---|---|---|---|
| 1 | 200 | 821.4 | 164.3 |
| 2 | 150 | 171.3 | 25.7 |
| 3 | 200 | 187.1 | 37.4 |
| | TOTAL | 1179.8 | 227.4 |

Figure 8:
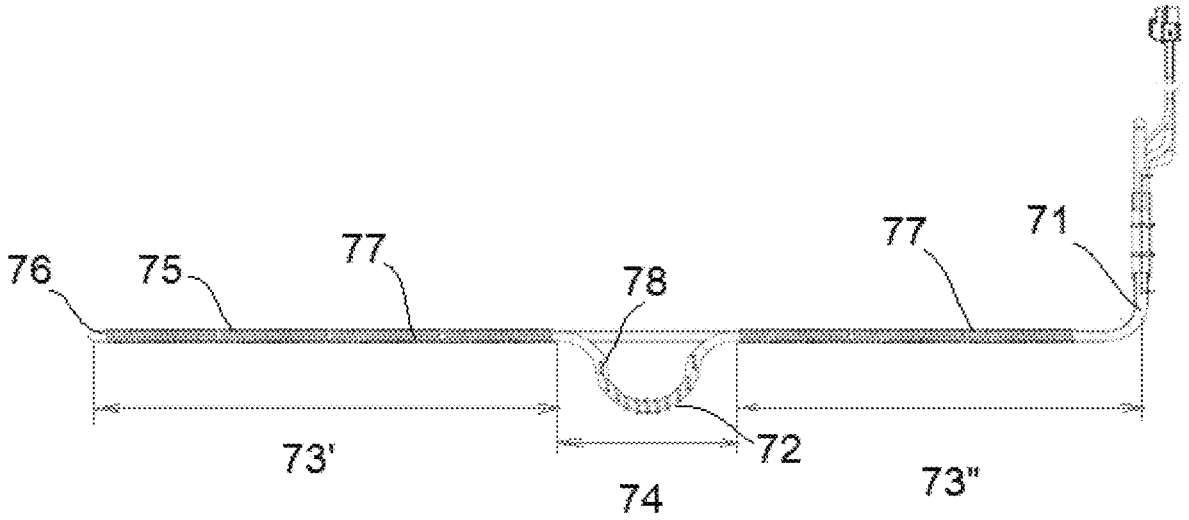
FIG. 8 is a schematic view of a portion of the defrost heater of FIG. 7A, according to an embodiment.

As further illustrated in FIG. 8, a portion of the heater tube 71 can include a resistive element, such as an electrical resistance wire 75, for example, that can be wound in a spiral manner around a cylindrical core 76 arranged within the heater tube 71. The electrical resistance wire 75 can be wound around the core 76 with a different density (i.e., pitch) depending on the specific section of the heater tube 71. For example, in the sections with relatively higher power output (e.g., sections 73' and 73") of the defrost heater 30, the electrical resistance wire 75 can be wound around the core 76 with a relatively higher density. In the section with relatively lower power output (e.g., section 74) of the defrost heater 30, the electrical resistance wire 75 can be wound around the core 76 with a relatively lower density. In other words, the windings 77 of the electrical resistance wire 75 in sections 73' and 73" of the defrost heater 30 can be wound closer together (as shown in FIG. 8) than the windings 78 of the electrical resistance wire 75 in section 74, which has a lower power output and where the windings 78 of the electrical resistance wire 75 can be wound apart from each other.

The different densities of the resistive element in sections 73' and 73", and section 74 of the defrost heater 30 can be designed based on whether the defrost heater 30 will be arranged in contact with the evaporator fins 58, which would impact the surface temperature of the defrost heater 30. Specifically, sections 73' and 73" of the defrost heater 30, which would be in contact with the evaporator fins 58, can be designed with a relatively higher power output (e.g., with a higher density of the windings 77) than section 74 of the defrost heater 30, which is spaced away from the evaporator fins 58, in order to reduce the surface temperature of the defrost heater 30 where the defrost heater 30 contacts the evaporator fins 58. Such a configuration can comply with the UL 250 standard (or other safety regulation), which requires that the surface temperature of the defrost heater does not exceed the safety limits established by the regulating agency. In one example, when using R600a refrigerant, the surface temperature of the defrost heater should be well below the 494° C. ignition point of the refrigerant, for example below 394° C. or less. Whether the defrost heater 30 is in contact with the evaporator fins 58 can be based on the location of the evaporator drain, for example, as described with reference to FIG. 7D above.

Figure 9:
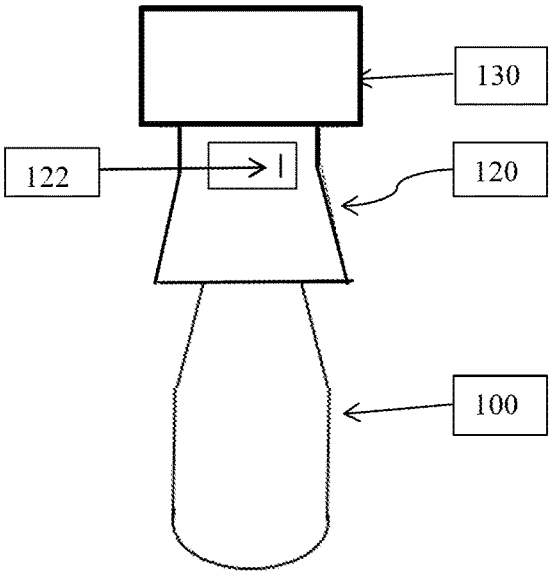
FIGS. 9-10 illustrate an example of a socket adaptor.
Figure 10:
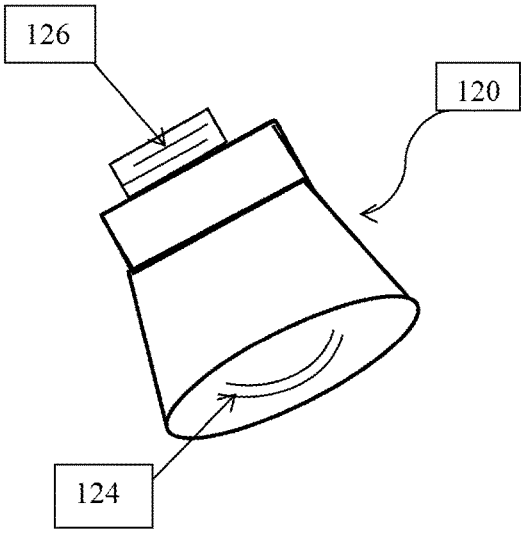

In another embodiment, as shown in FIGS. 9 and 10, the refrigerator 10 can include a socket adaptor 120 (FIG. 9) that is configured to supply power to an LED light 100 located in the fresh food compartment 14 and/or freezer compartment 12 when the refrigerator 10 is disconnected from a power supply. For example, the socket adaptor 120 can be utilized when the refrigerator 10 is being used as a point of purchase display, such as, for example, when the refrigerator 10 is located in an area of a showroom where power is not readily accessible.

In one example, the socket adaptor 120 features a male thread pattern 126 that is configured to be rotatably received by a female, threaded socket or plug 130 located in either the fresh food compartment 14 and/or freezer compartment 12. In this aspect, one could envision multiple versions of a socket adaptor being produced, wherein each version can include a male thread pattern that is complementary to a female threaded socket of particular refrigerator model. Further, while the present example of the socket adaptor 120 is presented for use in a refrigerator appliance, it is also contemplated that the adaptor could be modified for use in other appliances or furniture (e.g., a dishwasher, laundry machine, book shelf with closing doors, etc.).

Referring to FIG. 10, the adapter 120 includes a female receptacle 124 that is configured to rotatably receive a conductive, male screw thread (not shown in FIG. 10) of the LED light 100. The adaptor 120 is shown generally as frustoconically shaped having an outside diameter that increases towards a lower distal end of the adapter 120. However, other configurations of the adaptor 120 could also be contemplated (e.g., outside diameter may not vary).

Turning back to FIG. 9, a battery (not shown in FIG. 9) may be arranged in the adaptor 120 for distributing power to the LED light bulb 100. The design of the battery can embody multiple configurations (e.g., lithium-ion, nickel cadmium, nickel-metal hydride). In one example, a battery cover 122 could be removed from the adaptor 120 for replacing the battery as needed. For instance, the cover 122 could be removed using well known battery cover designs (e.g., clips with rear pins, etc.).

In one example, the adaptor 120 can only illuminate the LED light 100 when a door of the refrigerator 10 is opened. For instance, the door could be equipped with a switch (e.g., normally open switch) such that power will be distributed to the LED light 100 when the switch is closed (i.e., in a conductive state) and the door is opened.

In another embodiment, an application ("app") can be installed on a consumer's mobile device for interacting with one or more cameras (not shown in the figures) that may be arranged in the fresh food 14 and/or freezer compartment 12. In particular, the app could be configured to record an image of food items stored in either of the respective compartments for identifying the items stored therein. In one aspect, the app could identify and designate each item of a recorded image via image recognition technology. This aspect of the invention would enable a consumer to tag or add notes for each recorded item. In another example, a user could add notes regarding the expiration date of an item, or add other reminders by interacting with a user interface of the mobile device. In another aspect, a user could add notes regarding the expiration date of the item, or add other reminders (e.g., to purchase an ingredient). By confirming the availability of certain items via the recorded images, the app could also recommend recipe ideas, or recommend a shopping list for items that are needed to complete a recipe.

In yet another embodiment, the user could utilize the app for identifying an item located in the freezer compartment 12 that needs be thawed. For example, a user could select an item via the user interface of the mobile device and designate the item for transportation into an insulated thawing compartment (not shown in the figures) located in the freezer compartment 12. In one example, a mechanism (e.g., arm or conveyor system) could be provided (e.g., in the freezer compartment 12) for transporting the designated item into the thawing compartment. In this respect, a user could designate a target meal preparation time in the day (e.g., for dinner time), from which the app would adjust the temperature and time period required for thawing the designated item. In another example, the user could manually adjust the temperature of the thawing operation.

It is also contemplated that the arm or conveyor could transport the designated item through a mullion separating the freezer compartment 12 and the fresh food compartment 14 (e.g., through a screw elevator or conveyor system). For example, the aforementioned design could benefit remote users desiring to make meal plans while being away from home (e.g., at work for the day, etc.).

In a separate embodiment, FIGS. 11-14 illustrate one example of a wire housing assembly 200 that can be utilized for improving product assembly. In one example, the wire housing assembly 200 can be provided in a refrigerator machine room for storing wires related to a refrigerator compressor. However, it is also contemplated that the housing assembly 200 can be utilized to store wires related to other electronic circuitry (e.g., for use with an inverter).

Figure 11:
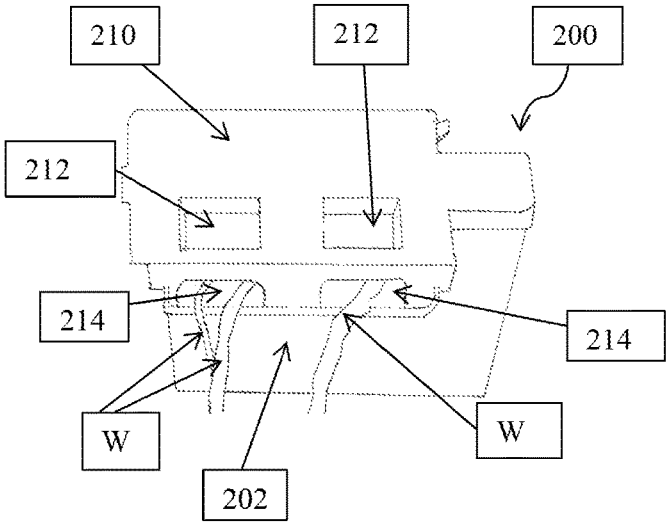
FIGS. 11-15 illustrate an example of a wire housing assembly.
Figure 12:
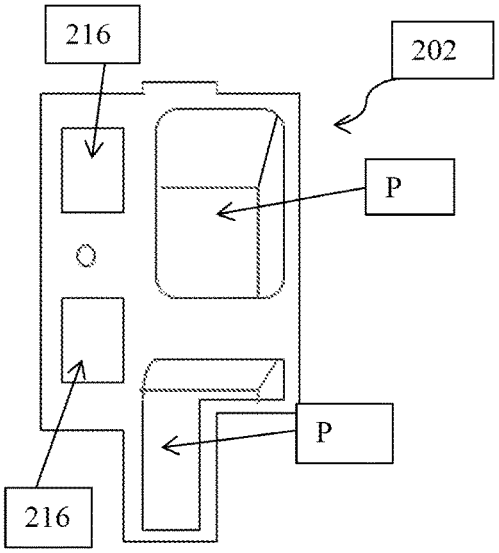
Figure 13:
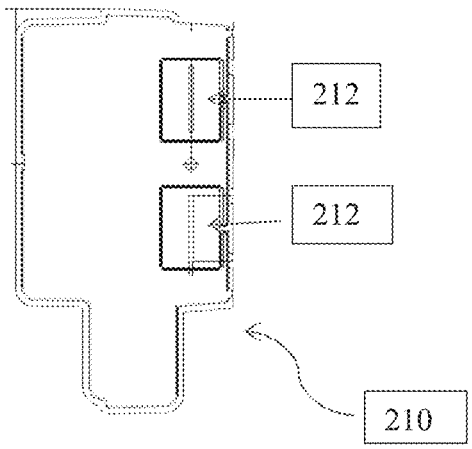
Figure 14:
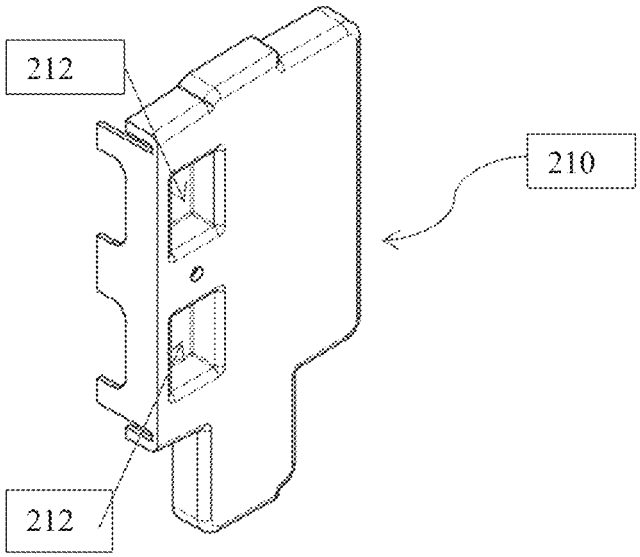

Referring to FIG. 11, the housing assembly 200 can include a housing body 202 and a removable cover 210. The cover 210 can be configured to be snapped onto the housing body 202 using well known retention features (e.g., resilient snaps, clips, etc.). Referring to FIG. 12, the housing body 202 features two pockets P that are formed therein for accommodating electronic components (not shown).

Operationally, wire harnesses W (FIG. 11) can be connected to the electronic components prior to being clamped into place via the cover 210. In particular, the wire harnesses W can be routed over two seating areas 216 formed at an upper surface of the housing body 202. Then, the cover 210 can be attached to the housing body 202. During this time, two inwardly protruding ribs or detents 212 (FIGS. 13 and 14) formed in the cover 210 can clamp or compress the wire harnesses W onto the two seating areas 216. In this respect, the cover 210 can be configured to lock the harnesses W into place when the cover 210 is secured to the housing body 202.

Figure 15:
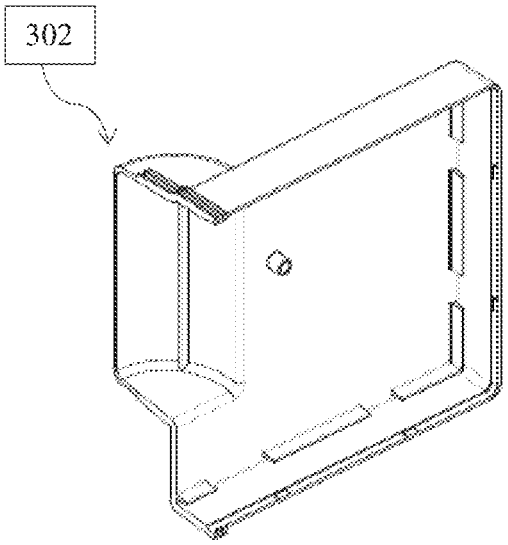

As can be appreciated, various configurations of a cover and housing body can be made available to accommodate varying types of electronic components and wire harness configurations. For example, and referring to FIG. 15, an alternative wire housing assembly can be formed to include a generally square shaped carrier body 302.

The aforementioned examples provide an open concept design that can enable assembly without having to manually route and secure wire harnesses into place via a separate wire clamp component.

Figure 16:
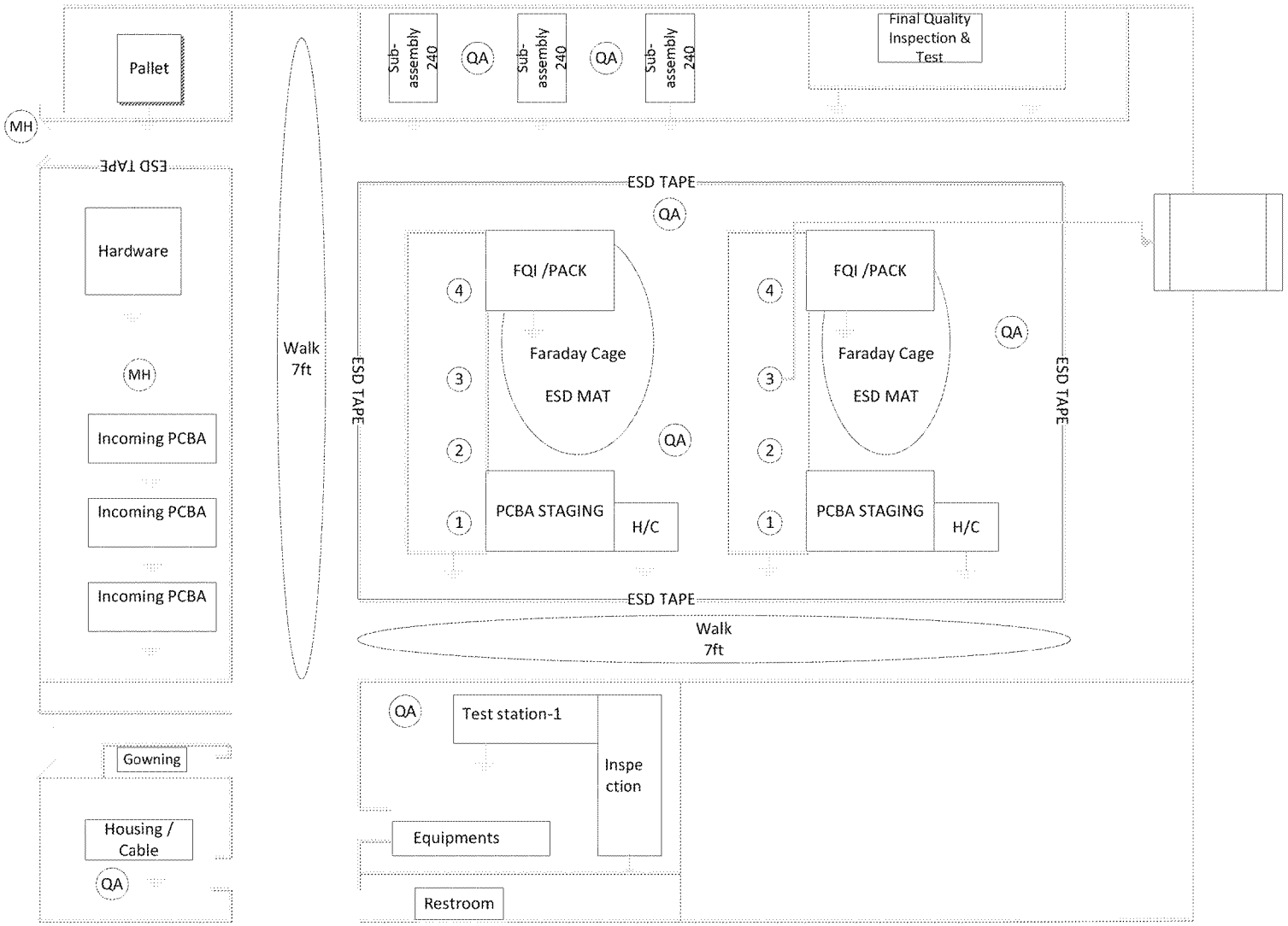
FIG. 16 illustrates an example of an offsite electronic assembly location.

In another embodiment, turning now to FIG. 16, a product manufacturing facility could employ an offsite electronic assembly location that can be designed to protect electronic product assemblies (e.g., printed circuit boards) and personnel from electro static discharge (ESD). ESD is a phenomenon that occurs when a charge is transferred (e.g., static discharge) between two bodies having unequal electric potential. For example, ESD can occur when two materials come into physical contact with each other, or when two materials are under the influence of an electric field. ESD can cause a charge body to send a static discharge to another body causing an electronic product or component to fail. The following example of an offsite electronic assembly location counters some of the negative effects associated with ESD, as described in further detail below.

As shown in FIG. 16, an ESD tape can surround the perimeter of the offsite electronic assembly location for preventing ESD from entering the work place assembly areas (e.g., Faraday cage, quality inspection, packing, etc.). In one example, the ESD tape can include an inner conductive material sandwiched in between two static dissipative layers for dissipating ESD (e.g., relying on Faraday shield design principles). Further, the assembly location can utilize one or a plurality of ESD mats for discharging ESD to earth ground. Like the ESD tape, the ESD mats can be constructed according to known Faraday shield design principles.

The offsite electronic assembly location disclosed herein can provide a number of benefits, such as, for example: protection of ESD sensitive product and personnel from ESD (e.g., in accordance with ANZI/ESD S20.20); mitigation of electrostatic discharge risk; an improvement in product quality; a reduction in product loss due to catastrophic damage; prevention of product reliability issues in the field (e.g., due to latent product damage); prevent discharge of accumulated charges on a product operator; reduction of static near a work bench; an increase in ESD sensitive product shelf life; a reduction in inventory costs; facilitation of just-in-time manufacturing; environment control for AC; elimination of dust in the work environment; reduction of operator and forklift traffic; faster software change implementation; ability to maintain an ionized air work environment; reduction of ESD damage due to environmental changes; control of unwanted particles that generate static; and a reduction of work shifts resulting in reducing assembly costs.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims and their equivalents.

What is claimed is:

1. A refrigeration appliance, comprising:

a storage compartment;

an evaporator that cools the storage compartment, said evaporator having a plurality of evaporator fins; and a defrost heater configured to be mounted at a bottom edge of the evaporator fins, the defrost heater comprising at least a first section and a second section, each comprising an electrical resistance wire wound in a spiral manner around a cylindrical core, wherein the first section of the defrost heater is in physical contact with the evaporator fins, and the second section of the defrost heater is spaced a distance away from the evaporator fins, wherein the first section of the defrost heater is configured with a relatively higher power output than the second section of the defrost heater, and wherein a density of the electrical resistance wire of the first section is higher than the density of the electrical resistance wire of the second section.

2. The refrigeration appliance of claim 1, wherein the evaporator fins comprise a plurality of slots formed at the bottom edge of the evaporator fins that are configured to receive a corresponding portion of the defrost heater comprising the first section of the defrost heater.

3. The refrigeration appliance of claim 2, wherein each of said plurality of slots is configured to provide a fitted pocket for the corresponding portion of the defrost heater, said fitted pocket creating an effective surface contact to increase a heat transfer and reduce a surface temperature of the defrost heater.

4. The refrigeration appliance of claim 1, wherein the defrost heater further comprises an elongated heater tube, wherein the electrical resistance wire and the cylindrical core are arranged within the heater tube.

5. The refrigeration appliance of claim 4, wherein the heater tube comprises a departing section configured to depart from the evaporator fins when the defrost heater is mounted at the bottom edge of the evaporator fins.

6. The refrigeration appliance of claim 5, wherein the departing section is at least one of a U-shaped and/or a V-shaped section.

7. The refrigeration appliance of claim 5, wherein the departing section is arranged proximate to an auxiliary defrost area, said departing section being configured to melt frost and ice accumulated around said auxiliary defrost area during a defrost cycle.

8. The refrigeration appliance of claim 7, wherein the auxiliary defrost area is proximate to at least one of an evaporator drain, a back side of a protective panel of the evaporator, an opening formed in a bottom of a drain trough or any portion of the drain trough, and/or beyond left and right ends of the defrost heater extending beyond the evaporator.

9. The refrigeration appliance of claim 5, wherein the heater tube comprises at least one straight section configured to be received within corresponding slots formed at the bottom edge of the evaporator fins.

10. The refrigeration appliance of claim 9, wherein the heater tube comprises at least two straight sections arranged on either side of the departing section, each of said at least two straight sections being configured to be received within corresponding slots formed at the bottom edge of the evaporator fins.

11. The refrigeration appliance of claim 9, wherein the at least one straight section is configured with a relatively higher power output than the power output of the departing section.

12. The refrigeration appliance of claim 1, further comprising a power supply configured to supply power to the defrost heater.

13. A method of defrosting an evaporator of a refrigeration appliance, wherein the refrigeration appliance comprises a defrost heater associated with the evaporator, said evaporator having a plurality of evaporator fins, the method comprising the steps of:

forming a plurality of slots at a bottom edge of the evaporator fins;

configuring the defrost heater with a departing section configured to depart from the evaporator fins when the defrost heater is mounted at the bottom edge of the evaporator fins and at least one straight section, each of the departing section and the at least one straight section comprising an electrical resistance wire wound in a spiral manner around a cylindrical core, wherein a density of the electrical resistance wire of the at least one straight section is higher than the density of the electrical resistance wire of the departing section;

mounting the defrost heater at the bottom edge of the evaporator fins, such that each of the plurality of slots forms a fitted pocket configured to receive a corresponding portion of the at least one straight section;

arranging the departing section proximate to an auxiliary defrost area;

energizing the departing section and the at least one straight section so that the departing section and the at least one straight section have different power outputs to defrost the evaporator; and melting frost and ice accumulated around said auxiliary defrost area by the departing section during defrost.

14. The method of claim 13, wherein the melting frost and ice accumulated around said auxiliary defrost area reduces a surface temperature of the defrost heater by transferring heat from the defrost heater to the evaporator fins.

15. The method of claim 13, further configuring the defrost heater with an elongated heater tube, wherein the electrical resistance wire and the cylindrical core are arranged within the heater tube.

16. The method of claim 13, wherein the step of energizing the departing section and the at least one straight section so that the departing section and the at least one straight section have different power outputs comprises energizing the at least one straight section with a relatively higher power output than the power output of the departing section.

17. The method of claim 13, wherein the auxiliary defrost area comprises at least one of an evaporator drain, a back side of a protective panel of the evaporator, an opening formed in a bottom of a drain trough or any portion of the drain trough, and/or beyond left and right ends of the defrost heater extending beyond the evaporator.

* * * * *